US009876284B2

(12) United States Patent
Romier

(10) Patent No.: US 9,876,284 B2
(45) Date of Patent: Jan. 23, 2018

(54) MULTIBEAM SOURCE

(71) Applicant: CENTRE NATIONAL D'ETUDES SPATIALES, Paris (FR)

(72) Inventor: Maxime Romier, Cugnaux (FR)

(73) Assignee: CENTRE NATIONAL D'ETUDES SPATIALES (FR)

( * ) Notice: Subject to any disclaimer, the term of this patent is extended or adjusted under 35 U.S.C. 154(b) by 233 days.

(21) Appl. No.: 14/349,867

(22) PCT Filed: Oct. 5, 2012

(86) PCT No.: PCT/EP2012/069699
§ 371 (c)(1),
(2) Date: Aug. 1, 2014

(87) PCT Pub. No.: WO2013/050517
PCT Pub. Date: Apr. 11, 2013

(65) Prior Publication Data

US 2014/0333498 A1 Nov. 13, 2014

(30) Foreign Application Priority Data

Oct. 5, 2011 (FR) ..... 11 58993

(51) Int. Cl.
*H01Q 25/00* (2006.01)
*H01P 5/12* (2006.01)
(Continued)

(52) U.S. Cl.
CPC ..... *H01Q 25/00* (2013.01); *H01P 5/12* (2013.01); *H01Q 15/242* (2013.01);
(Continued)

(58) Field of Classification Search
CPC .... H01Q 25/00; H01Q 21/005; H01Q 15/242; H01Q 21/06; H01Q 19/10
(Continued)

(56) References Cited

U.S. PATENT DOCUMENTS 4,710,776 A * 12/1987 Roederer ..... H01Q 25/007 333/117
2003/0006941 A1* 1/2003 Ebling ..... H01Q 3/242 343/911 R
(Continued)

FOREIGN PATENT DOCUMENTS

GB 1508726 A 4/1978

OTHER PUBLICATIONS

Ralf Gehring, Jurgen Hartmann, Christian Hartwanger, Unpyo Hong, Norbert Ratkorn, Enrico Reiche, Helmut Wolf: "Trade-Off for Overlapping Feed Array Configurations", 29th ESA Antenna Workshop on Multiple Beams and Reconfigurable Antennas, Apr. 18, 2007 (Apr. 18, 2007), Apr. 20, 2007 (Apr. 20, 2007), XP002674198, ESTEC, Noordwijk, the Netherlands Retrieved from the Internet: URL:http://www.astrium.eads.net/media/document/2007-esa-antenna-workshop-trade-off-for-overlapping-feed.pdf>[Apr. 19, 2012].
(Continued)

*Primary Examiner* — Dameon E Levi
*Assistant Examiner* — Andrea Lindgren Baltzell
(74) *Attorney, Agent, or Firm* — Lerner, David, Littenberg, Krumholz & Mentlik, LLP

(57) ABSTRACT

The invention relates to a multibeam source for a multibeam antenna, the source comprising a plurality of identical basic sources, such that the basic sources are combined into identical subnetworks around a central basic source, each subnetwork forming a beam, and such that two adjacent subnetworks comprise at least one common basic source, wherein the source includes: a supply and polarization stage for supplying power to the central basic sources and polarizing the electromagnetic field at the accesses of the central basic sources; and a stage for distributing the power from the central basic sources among the basic sources of the corre-
(Continued)

sponding subnetwork and those common to a plurality of subnetworks according to a predetermined amplitude law.

11 Claims, 5 Drawing Sheets

(51) Int. Cl.

| | |
|---|---|
| ***H01Q 19/17*** | (2006.01) |
| ***H01Q 21/06*** | (2006.01) |
| ***H01Q 15/24*** | (2006.01) |
| ***H01Q 19/10*** | (2006.01) |
| ***H01Q 21/00*** | (2006.01) |

(52) U.S. Cl.
CPC ..... *H01Q 19/10* (2013.01); *H01Q 19/17* (2013.01); *H01Q 21/005* (2013.01); *H01Q 21/06* (2013.01); *H01Q 21/064* (2013.01); *H01Q 25/007* (2013.01)

(58) Field of Classification Search
USPC ..... 343/755, 756
See application file for complete search history.

(56) References Cited

U.S. PATENT DOCUMENTS

| | | | | |
|---|---|---|---|---|
| 2007/0195004 | A1* | 8/2007 | Rebeiz ..... | H01Q 1/3233 343/876 |
| 2009/0015372 | A1 | 1/2009 | Kady | |
| 2009/0259321 | A1 | 10/2009 | Stellari et al. | |
| 2011/0109437 | A1 | 5/2011 | Olsson | |
| 2013/0113648 | A1 | 5/2013 | Duvoisin, III et al. | |

OTHER PUBLICATIONS

Michael Schneider: "MEDUSA—Mehrmodige Multi-Spot-Beam Antenne—Technischer Bericht zum F6rdervorhaben 50YB0714", Nov. 22, 2010 (Nov. 22, 2010), pp. 1-40, XP055025012, Hannover Retrieved from the Internet: URL:http:ffedok01.tib.uni-hannover. dejedok s/e01fb11/657469076.pdf [retrieved on Apr. 19, 2012] the whole document.

Ratkorn N et al: "MEDUSA—A Multiple Feeds per Beam Multi Spot Beam Antenna Project", 30th ESA Antenna Workshop on Antennas for Earth Observation, Science, Telecommunication and Navigation Space Missions: Innovation and Challenges, May 27-30, 2008, ESA/ESTEC, Noordwijk, the Netherlan• May 27, 2008 (May 27, 2008). p. 1PP. XP009158512, Retrieved from the Internet: URL:http:ffwww.congrex.nl/08c05/Sessions/Session %201.htm> [retreived Apr. 19, 2012].

Michael Schneider, Christian Hartwanger and Helmut Wolf: "Antennas for multiple spot beam satellites", CEAS Space Journal, Aug. 10, 2011 (Aug. 10, 2011), Aug. 10, 2011 (Aug. 10, 2011), pp. 59-66, XP002674197, Springer, Wien, Austria DOI: 10.1007/ s12567-011-0012-z Retrieved from the Internet: URL:http:ffwww. springerlink.comjcontentjp6 868277636x5030/fulltext.pdf [retrieved on Apr. 19, 2012] the whole document.

International Search Report for Application No. PCT/EP2012/ 069699 dated Oct. 29, 2012.

International Search Report for Application No. PCT/EP2014/ 066861 dated Jan. 9, 2015.

International Preliminary Search Report for Application No. FR 1357786 dated Apr. 8, 2014.

* cited by examiner

MULTIBEAM SOURCE

The invention relates to a multibeam source for a multibeam antenna, where the source includes multiple identical elementary sources, such that: the elementary sources are grouped into identical subnetworks around a central elementary source, where each subnetwork is intended to form a beam, and where two adjacent subnetworks include at least one elementary source in common; where the source includes a power and polarisation stage (10) to provide power to polarise the electromagnetic field at the entry points of the central elementary sources; and a stage (20) for distributing the power from the central elementary sources to the elementary sources of the corresponding subnetwork, and those common to several subnetworks according to a determined amplitude law.

CROSS REFERENCE TO RELATED APPLICATIONS

The present application is a national phase entry under 35 U.S.C. § 371 of International Application No. PCT/EP2012/069699 filed Oct. 5, 2012, which claims priority from French Patent Application No. 1158993, filed Oct. 5, 2011, the disclosures of which are incorporated by reference herein.

GENERAL TECHNICAL FIELD

The invention relates to the field of satellite telecommunications. In particular it relates to a multibeam source for a multibeam antenna.

STATE OF THE ART

Multibeam antennae for spot coverage of a given geographical area are used in satellite communications.

The main purpose of this technology is to reduce the per-bit transmission cost by using optimally the frequency band allocated to a given application.

Current techniques use multibeam antenna systems operating with a variety of frequencies and a variety of polarisation modes.

These techniques are similar to those used for terrestrial communications networks known as "cellular" networks.

With this technique the distribution of the signals is such that two adjacent cells do not have signals having the same characteristics, i.e. signals with the same frequency and the same polarisation mode. Conversely, identical signals are re-used in non-adjacent cells in order to increase the system's capacity.

In a known manner, a multibeam antenna of the "multiple sources by beams" type includes a multibeam source positioned next to the focus of a focusing system consisting of one or more reflectors. The multibeam source includes several elementary sources arranged in subnetworks.

A subnetwork enables a beam to be formed having a given frequency and a given polarisation mode.

Habitually, in the case of satellite transmissions, the allocated frequency band is divided into two sub-bands of frequencies $F_1$ and $F_2$, and two orthogonal polarisation modes, either linear (horizontal H and vertical V) or circular (right PCG or left PCD) are used.

The subnetworks of a diagram for re-use by four (four-colour diagram) are defined as follows: F1+H (or PCG); F1+V (or PCD); F2+H (or PCG); F2+V (or PCD).

Seven elementary sources contribute to the formation of a beam, called septets. Septets used for two adjacent beams have overlapping areas.

FIG. 1 illustrates such a frequency and polarisation re-use diagram.

The subnetworks are grouped in such a way that two adjacent subnetworks have elementary sources in common. In FIG. 1 several subnetworks of seven elementary sources are grouped (septets). Each subnetwork is hexagonal in shape.

By interlacing subnetworks the area used for the formation of a beam can be increased, and therefore its RF characteristics can be improved.

To form the beams the multibeam source includes a Beam Forming Network (BFN).

Conventionally the BFN includes N entry points, equal to the number of beams. A signal powering an entry point is distributed with a phase and amplitude weighting which is predetermined for all the sources of one of the subnetworks. The purpose of the BFN is to distribute the signals from the entry points to the elementary sources of each subnetwork, bearing in mind that adjacent subnetworks have overlapping areas.

A BFN is known which consists of several 2:2 couplers powering subnetworks some elementary sources of which are shared with other subnetworks. To this end reference may be made to the document N. Ratkorn, M. Schneider, R. Gehring, H. Wolf, "MEDUSA—A Multiple Feeds per Beam Multi Spot Beam Antenna Project", 30th ESA Antenna Workshop, Noordwijk, Netherlands, 27-30 May 2008. The document R. Gehring, J. Hartman.

This BFN structure therefore includes a succession of 2:2 couplers connected to one another by a network of waveguides. Routing of the waveguides is made difficult due to the fact that the network of elementary antennae is two-dimensional, and that adjacent subnetworks have overlaps. Consequently the solution obtained is constrictive in terms of manufacture and of calibration, if applicable, of the elements located within the BFN.

PRESENTATION OF THE INVENTION

One goal of the invention is to have a multibeam source enabling subnetworks to be interlaced in a simple manner.

To this end the invention relates to a multibeam source for a multibeam antenna, where the source includes multiple identical elementary sources, such that:

- the elementary sources are grouped into identical subnetworks around the central elementary source, where each subnetwork is intended to form a beam, and where two adjacent subnetworks include at least one elementary source in common;
- where the source includes
- a power and polarisation stage to power and polarise the electromagnetic field at the entry points of the central elementary sources;
- and a stage for distributing the power derived from the central elementary sources to the elementary sources of the corresponding subnetwork, and those which are common to several subnetworks according to a determined amplitude law;

where the source is characterised in that the distribution stage consists of multiple parallel waveguides aligned in an axis of radiation of the said source, where each waveguide corresponds to each elementary source, and where they are arranged one relative to the next such that, for a subnetwork, one central waveguide corresponds to the central elementary source, and peripheral waveguides are connected radially to the central waveguide, such that the waveguides corresponding to the elementary sources common to several subnetworks are connected to one another.

The invention also relates to a multibeam antenna including a focusing system and also a multibeam source according to the first aspect of the invention positioned close to the focus of the said focusing system.

The invention is advantageously completed by the following characteristics, considered singly or in any technically possible combination:

- the waveguides are connected by means of coupling slots positioned radially around the waveguide so as to couple the fundamental mode of the central guide and the fundamental mode of the peripheral guide, where fundamental mode is defined as the first propagating mode;
- the spacing between the coupling slots is less than half the wavelength guided in the central waveguide at the operating frequency, and is preferably a quarter of the guided wavelength of the central waveguide at the operating frequency;
- the number of coupling slots depends on power difference between the power radiated by the central elementary source and the power radiated by the elementary sources of the corresponding subnetwork, where apodisation typically varies between 0 and 10 dB;
- the unconnected coupling slots of the networks located at the periphery are terminated by appropriate loads or metal walls positioned at their ends;
- the entry stage includes a polariser configured to operate in circular or linear polarisation mode, corresponding to each central elementary source;
- it includes a phase shifter positioned after the distribution stage to control the phase of the signals emitted by the waveguides;
- the distribution stage and the phase shifter are formed, for an elementary source, by a single variable-section waveguide;
- the waveguides for each elementary source and the connections between the guides are formed by a stack of layers of material, typically aluminium or invar;
- each subnetwork consists of seven sources, a central elementary source and six elementary sources positioned around the central elementary source;
- the distribution stage includes several directional 1:7 couplers consisting of a central guide and six peripheral guides positioned around the central waveguide.

The invention has many benefits.

Coupling of the sources of a subnetwork is facilitated through the use of multi-directional coupling slots. Use of a succession of 2:2 couplers is therefore avoided.

PRESENTATION OF THE FIGURES

Other characteristics and benefits of the invention will also be revealed from the description which follows, which is purely illustrative and not restrictive, and must be read in the light of the appended illustrations in which, apart from FIG. 1, which has previously been discussed:

FIGS. 2*a*, 2*b* and 2*c* illustrate schematically the structure of a multibeam source according to the invention;

FIGS. 3*a* and 3*b* illustrate respectively a section and a front profile view of a septet of the source according to the invention;

In all the figures similar elements have identical numerical references.

DETAILED DESCRIPTION OF THE INVENTION

The description which follows is made in relation with FIGS. 2*a* to 6.

A multibeam source includes multiple elementary sources arranged, for example, in a triangular mesh, which are grouped into subnetworks, each including elementary sources S11, S12, S13, S14, S15, S16 positioned around a central elementary source S1.

A subnetwork includes, for example, seven elementary sources, the term then used being septets. In this case the subnetwork includes six elementary sources S11, S12, S13, S14, S15, S16 positioned around a central elementary source S1.

Figure 1:
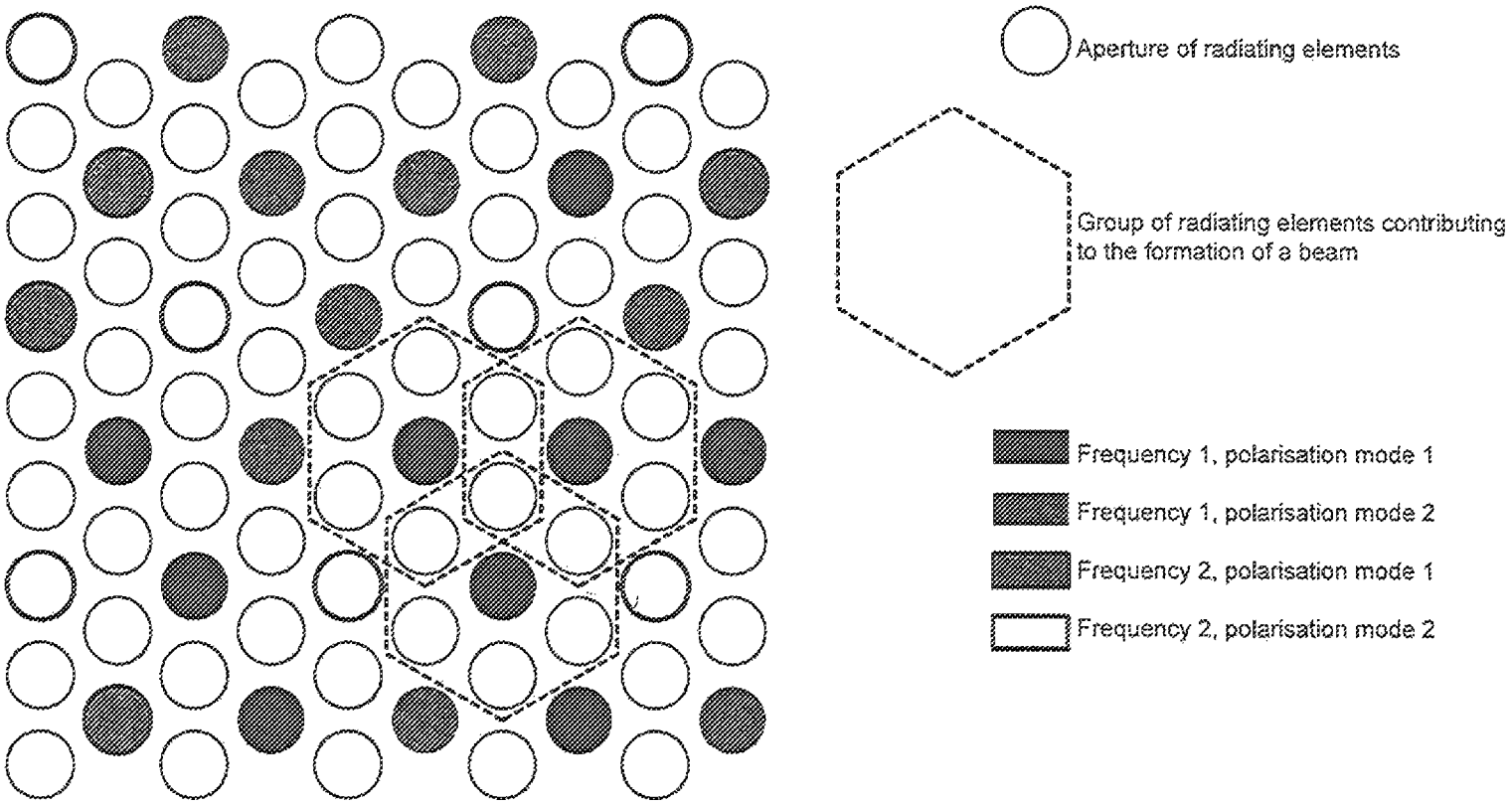

As has been mentioned, to obtain the interlacing of the subnetworks the subnetworks are grouped such that two adjacent subnetworks have elementary sources in common (as illustrated in FIG. 1).

Figure 4:
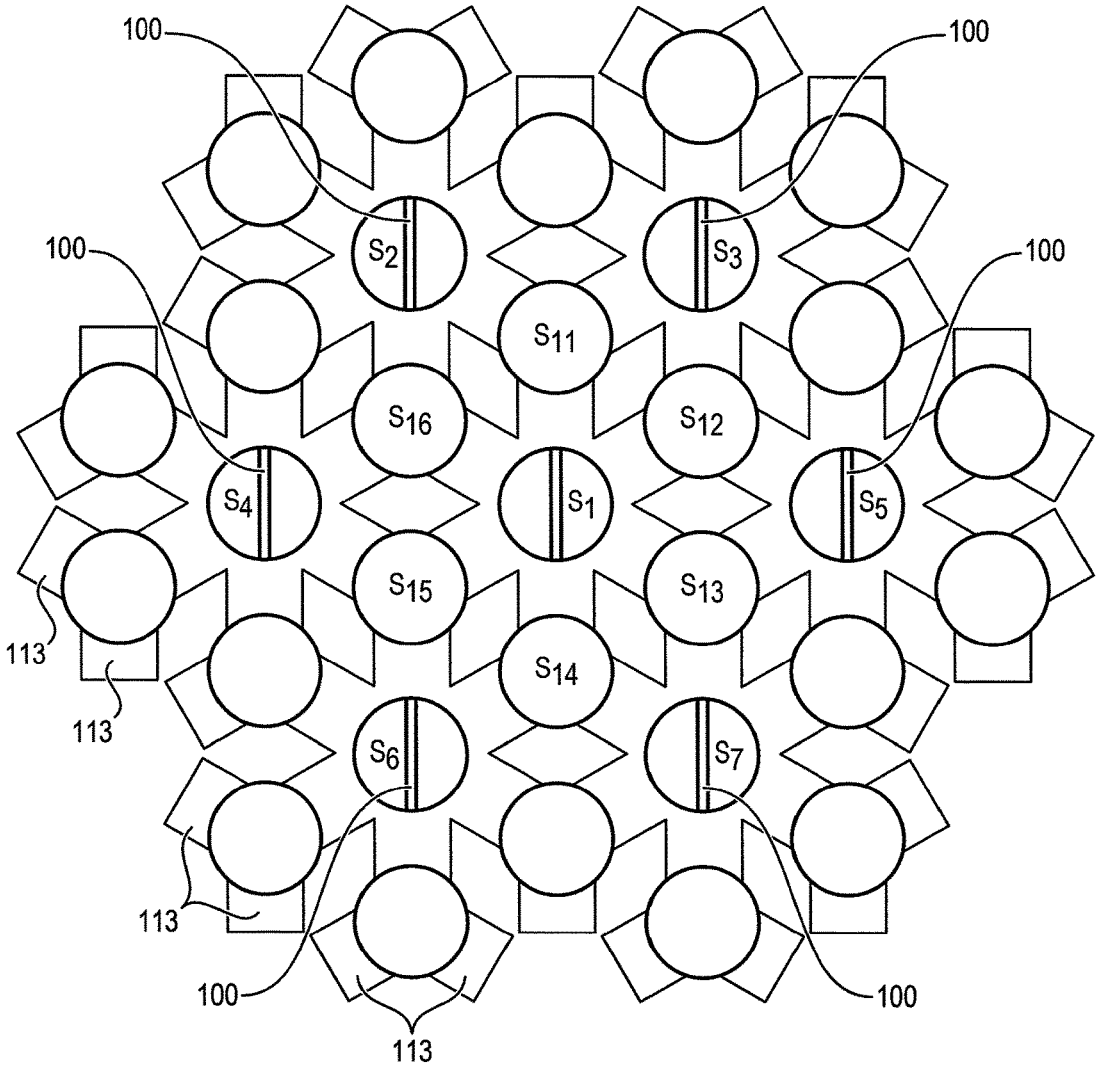
FIG. 4 illustrates a front view of a source according to one embodiment of the invention.

As is illustrated in FIG. 4, seven subnetworks are grouped, some of which have elementary sources in common. Each subnetwork is hexagonal in shape (see FIG. 1).

The multibeam source consists of several stages (see FIG. 2*a*) including:

- a power and polarisation stage 10 to power and polarise the electromagnetic field at the entry points of the central elementary sources S1-S7; and
- a distribution stage 20 to distribute the power between central elementary source S1-S7 and the elementary sources of the subnetwork, and also between the sources common to several subnetworks.

To polarise the radiated field a polariser 100 (double lines in FIGS. 2*c*, 4) is positioned either at each entry point of the distribution stage, or at each output point of the distribution stage.

Figure 2C:
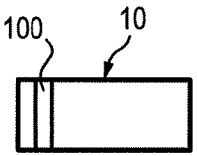
Figure 2A:
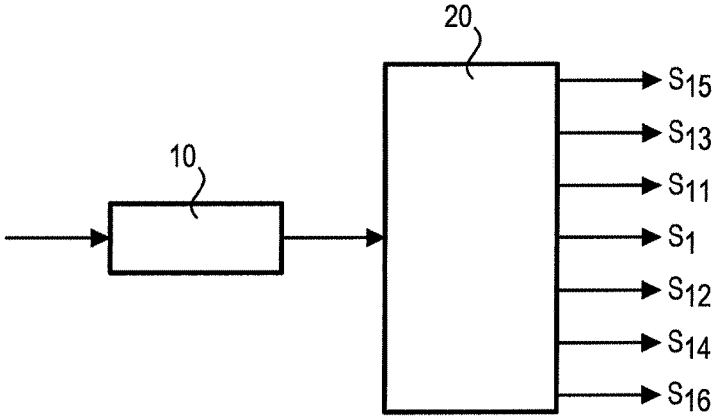
Figure 2B:
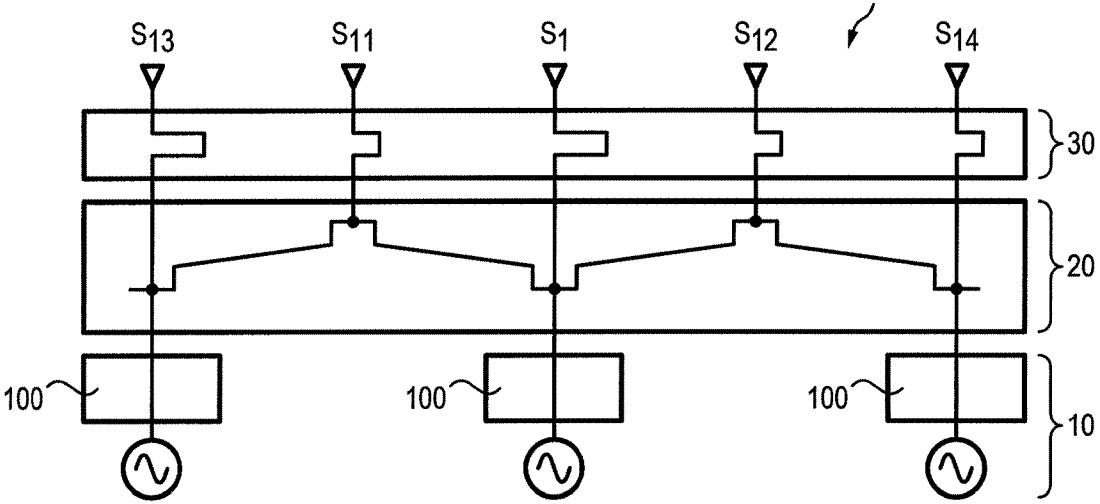

In a complementary manner the multibeam source includes a phase shifter 20 which enables the phase of the signals from distribution stage 30 to be adjusted (see FIG. 2*b*).

Figure 5:
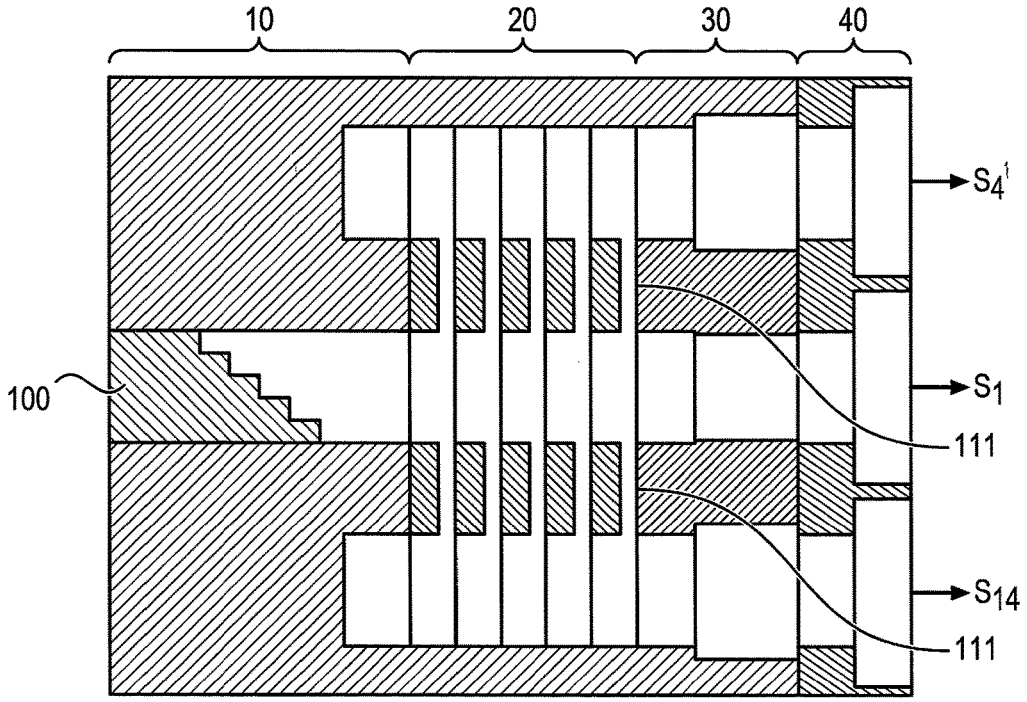
FIG. 5 illustrates a section view of FIG. 4.

Finally, the source includes a radiating stage 40 typically consisting of cones connected after phase shifter 30, for each elementary source (see FIG. 5).

Figure 3A:
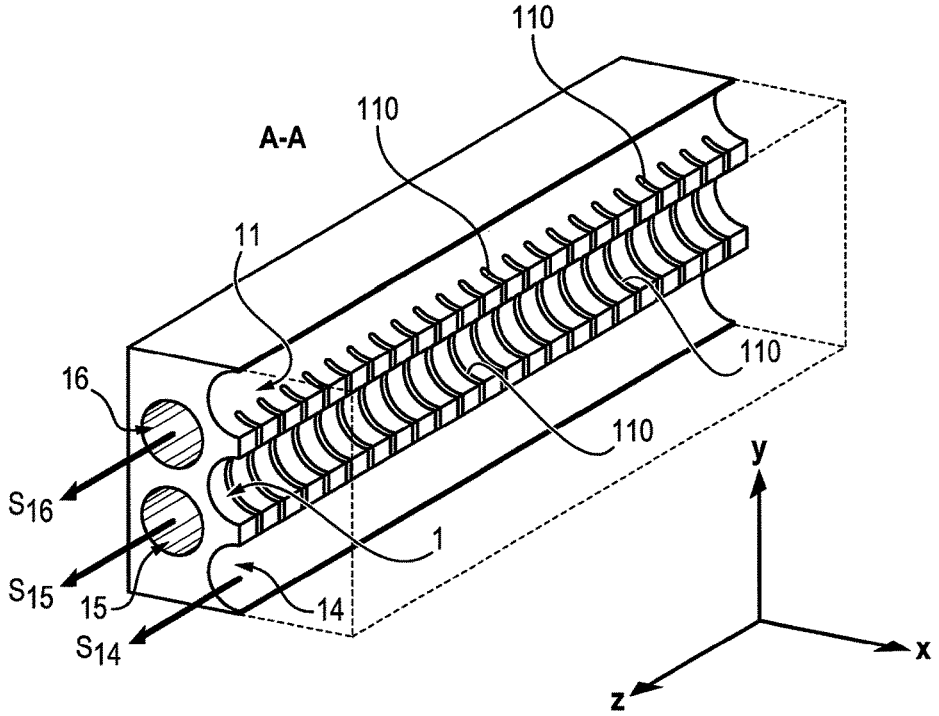
Figure 3B:
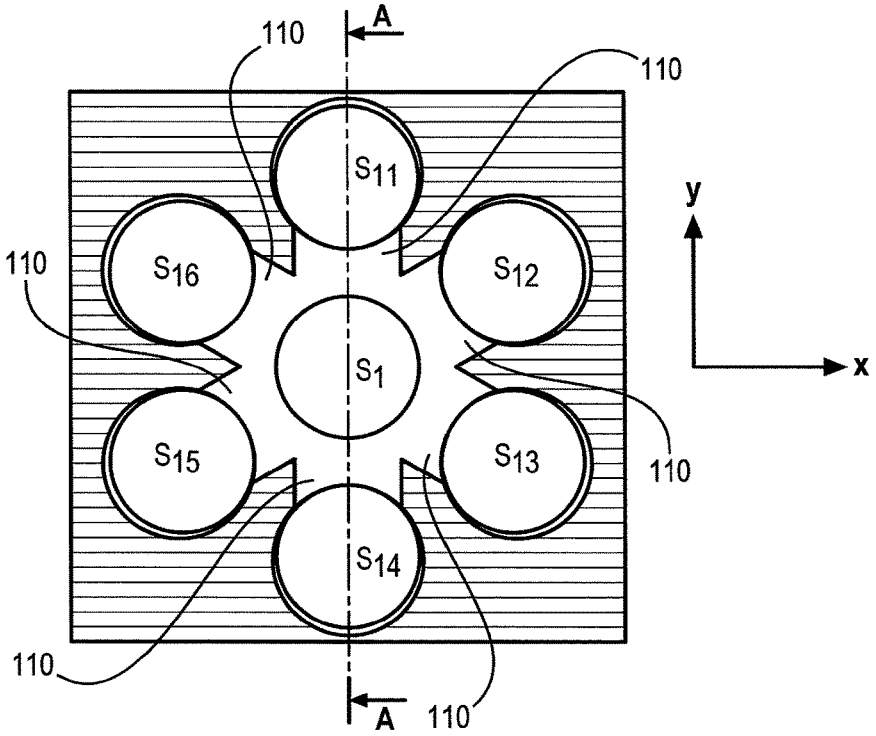

Distribution stage 30 consists of several waveguides. FIG. 3*b* illustrates as a perspective view and as a section view the positioning of five waveguides 1, 11, 14, 15, 16 of a septet.

For a subnetwork: a central waveguide 1 corresponds to central elementary source S1 and six peripheral guides are coupled radially to central waveguide 1. The entry points of the peripheral guides can be terminated either by short circuits or by appropriate loads intended to absorb any residual power which may be propagated in the opposite direction.

In other words, a subnetwork is in fact a 1:7 coupler consisting of a central waveguide 1 corresponding to central elementary source S1 and six peripheral guides S11, S12, S13, S14, S15, S16 which correspond to the peripheral guides.

The waveguides have a circular, oval, hexagonal or square section.

The peripheral guides are connected to the central guide through coupling slots 110. In particular, in the case of the 1:7 coupler the peripheral guides and the central guides are coupled to one another through six rows of coupling slots 110.

FIG. 3*b* illustrates a front view of a septet.

The coupling slots are typically rectangular in shape, and are connected firstly to the central waveguide and secondly to one of the peripheral guides of the subnetwork. The width of the coupling slots is between a half wavelength A and the diameter of the peripheral waveguide. The coupling slots may include isolation devices allowing the energy of the central guide to be propagated to the peripheral guide, whilst prohibiting propagation in the opposite direction. The isolation devices may be produced using ferrites, for example.

In the case of a source having several subnetworks some sources are shared. In this case the waveguides corresponding to the elementary sources are coupled in the same way (see FIG. 4).

Since the subnetworks are interlaced certain waveguides are connected by coupling slots 110 to the central waveguides of adjacent subnetworks, and the waveguides corresponding to the elementary sources common to several subnetworks are connected to one another.

In other words, the 1:7 couplers are interlaced, i.e. the peripheral guides (elementary sources S11, S12, S13, S14, S15, S16) participate simultaneously in several adjacent subnetworks, and the peripheral guides are connected in parallel through rows of coupling slots to three adjacent central guides.

The coupling slots are separated by an interval of less than $\lambda g_{(central\ guide)}/2$ where $\lambda g_{(central\ guide)}$ is the wavelength guided in the central waveguide calculated in the frequency band which is to be coupled.

The number of coupling slots is chosen such that the coupling area is between four and eight times $\lambda g_{(central\ guide)}$. The spacing between the coupling slots and the number of coupling slots must be optimised to guarantee a satisfactory coupling.

In a preferred manner, the number of coupling slots depends on the difference between the power radiated by the central elementary source and the power radiated by the elementary sources of the corresponding subnetwork, where apodisation typically varies between 0 and 10 dB.

For each subnetwork the structure is symmetrical, which enables the generation of modes of a higher order, likely to be propagated, depending on the diameter of the waveguides and the frequency, to be minimised.

Unconnected coupling slots 113 of the subnetworks located at the periphery are advantageously terminated by short-circuits (reflecting the incident field in the slot) or loads modified (absorbing the incident field in the slot) to optimise the operation of these subnetworks. The function of the modified loads consisting of lossy material is to cancel the reflection of the energy propagated in the unconnected coupling slots, which may degrade the RF performance of the subnetworks located at the periphery.

In FIG. 5 a section view along axis BB of FIG. 4 is represented. In this case coupling is provided by five rectangular coupling slots 111.

Figure 6:
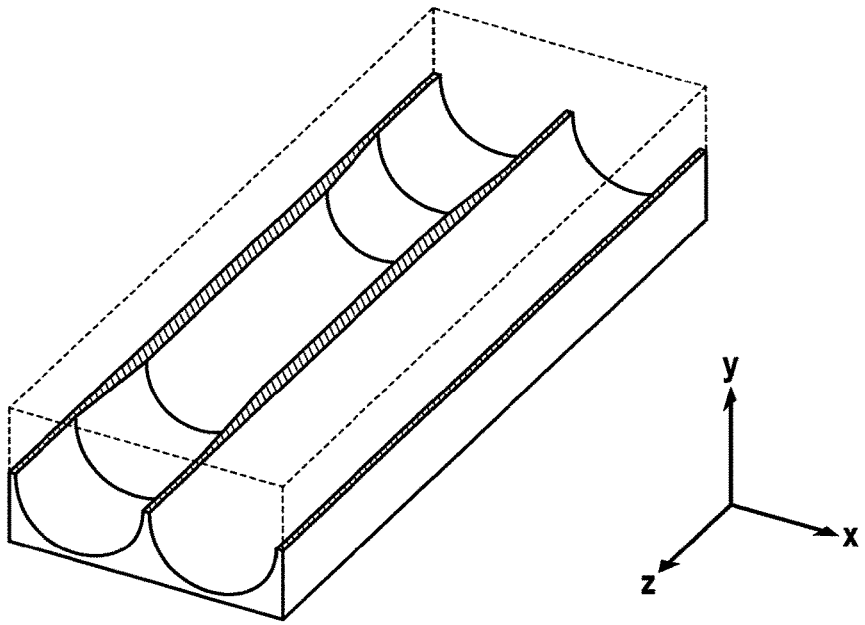
FIG. 6 illustrates a view of two waveguides of the source according to the invention.

Phase shifter 30 consists, for an elementary source, of a variable-section waveguide enabling the guided wavelength, and therefore the output phase, to be modulated. FIG. 6 illustrates this principle with two waveguides of identical length enabling differentiated output phases to be obtained.

As with the distributor phase, the phase shifter may be produced by a stack of machined metal layers.

By this means it is possible to have a multibeam source formed by a stack of layers of material. In a preferential manner the material used is identical for all the layers, with the aim of facilitating uniform mechanical and thermoelastic properties. Material such as aluminium or invar may be used.

The invention claimed is:

1. A multibeam source for a multibeam antenna, comprising:

several subnetworks, each comprising several identical elementary sources evenly distributed around a central elementary source, each subnetwork being intended to form a beam, and two adjacent subnetworks comprising at least one elementary source in common;

a power and polarisation stage to power and polarise the electromagnetic field at the entry points of the central elementary sources; and a stage for distributing the power derived from the central elementary sources to the elementary sources of the corresponding subnetwork, and those which are common to several subnetworks according to a determined amplitude law;

wherein:

the distribution stage is constituted by several parallel waveguides aligned in an axis of radiation of the said source, one elementary source being associated to one waveguide, the waveguides being arranged relative to one another such that, for a subnetwork, one waveguide corresponds to the central elementary source and peripheral waveguides are all connected radially to the central waveguide and are evenly distributed around the central waveguide in the same plane, the waveguides corresponding to the elementary sources common to several subnetworks are connected to one another, the waveguides are connected by means of coupling slots positioned radially around the waveguide in the same plane so as to couple the fundamental mode of the central guide and the fundamental mode of the peripheral guide, where the fundamental mode is defined as the first mode of propagation.

2. A multibeam source according to claim 1, in which the spacing between the coupling slots is less than half the guided wavelength in the central waveguide at the operating frequency, and is preferably a quarter of the guided wavelength of the central waveguide at the operating frequency.

3. A multibeam source according to claim 1, wherein the number of coupling slots depends on the difference between the power radiated by the central elementary source and the power radiated by the elementary sources of the corresponding subnetwork, wherein apodisation typically varies between 0 and 10 dB.

4. A multibeam source according to claim 1, wherein the unconnected coupling slots of the networks located at the periphery are terminated by appropriate loads or metal walls positioned at their ends.

5. A multibeam source according to claim 1, wherein the entry stage includes a polariser able to operate in circular or linear polarisation mode corresponding to each central elementary source.

6. A multibeam source according to claim 1, including a phase shifter positioned after the distribution stage to control the phase of the signals emitted by the waveguides.

7. A multibeam source according to claim 1, wherein the distribution stage and the phase shifter are formed, for an elementary source, by a single variable-section waveguide.

8. A multibeam source according to claim 1, wherein the waveguides corresponding to each elementary source and the connections between the guides are formed by a stack of layers of material, typically aluminium or invar.

9. A multibeam source according to claim 1, wherein each subnetwork consists of seven sources, one central elementary source and six elementary sources positioned around the central elementary source.

10. A multibeam source according to claim 1, wherein the distribution stage includes multiple directional 1:7 couplers consisting of a central guide and six peripheral guides positioned around the central waveguide.

11. A multibeam antenna including a focusing system consisting of one or more reflectors together with a multibeam source according to claim 1, positioned close to the focus of the said focusing system.

* * * * *